United States Patent [19]

Schmidt

[11] Patent Number: 4,660,234

[45] Date of Patent: Apr. 28, 1987

[54] BATHTUB INSERT FOR HANDICAPPED PERSONS

[76] Inventor: Peter Schmidt, Wittumweg 38, D-7989 Eisenharz, Fed. Rep. of Germany

[21] Appl. No.: 827,593

[22] Filed: Feb. 10, 1986

[30] Foreign Application Priority Data

Mar. 7, 1985 [DE] Fed. Rep. of Germany ..... 3508056

[51] Int. Cl.[4] ..... A47K 3/12

[52] U.S. Cl. ..... 4/566

[58] Field of Search ..... 4/564–566, 4/495, 504

[56] References Cited

U.S. PATENT DOCUMENTS 2,242,939 5/1941 Buckel ..... 4/565
2,725,578 12/1955 Keller ..... 4/566 X
2,772,721 12/1956 Saunders ..... 4/560 X
4,419,776 12/1983 Schmidt ..... 4/566 X
4,557,002 12/1985 Schmidt ..... 4/566 X

*Primary Examiner*—Charles E. Phillips
*Attorney, Agent, or Firm*—Angelo Notaro

[57] ABSTRACT

A bathtub insert for handicapped persons comprises a bottom frame, a seat plate, two pairs of scissor arms therebetween and a hose fillable with water in order to elevate the seat plate. A flexible cover sheet closes the front end of the bathtub insert between the seat plate and the bottom frame. One end of the cover sheet is fastened at a winding tube and a torsional spring therein holds the cover sheet tightly tensioned even in the lowermost position of the seat plate. The cover sheet at the same time avoids that handicapped persons can be injured by jamming their arms and legs and holds the bathtub insert in a flat-package transportable position.

10 Claims, 4 Drawing Figures

BATHTUB INSERT FOR HANDICAPPED PERSONS

BACKGROUND OF THE INVENTION

The invention relates to a bathtub insert for handicapped persons comprising a bottom frame, a seat plate, a scissor-type guiding device arranged between said bottom frame and said seat plate and a lifting device consisting of a water-fillable hose closed at its ends, one end of the hose fastened at the bottom frame and the other end fastened at the seat plate, a pair of swinging plates pivotably connected at opposite side edges of the seat plate respectively and by spring means pre-stressed into the plane of the seat plate respectively.

A bathtub insert of this kind is known from my U.S. Pat. No. 4,407,029. In this known bathtub insert the seat plate extends substantially over the whole length of the bathtub and is provided with a pair of swinging plates at the front and rearward ends of the seat plate. Therefore, during lowering of the seat plate all gaps between the seat plate and the walls of the bathtub are closed and the handicapped person cannot get his hands and feet caught between the seat plate and the bathtub. However, a bathtub insert of this kind is expensive and creates some problems with respect to transportation and storage.

If the handicapped person is able to sit on the lifted plate a smaller bathtub insert can be used as proposed in U.S. Pat. Nos. 2,725,578 and 2,772,721. In these constructions however, the problem exists that the handicapped person tries to hold himself fast to the seat plate when the latter is lowered. Handicapped persons cannot fully control movements of their arms and legs. Therefore, the danger of squeezing in hands, arms and legs does exist in the insert according to U.S. Pat. No. 2,725,578 especially between the stiffening rings of the bellows and between the seat plate and the bottom frame. In the insert according to U.S. Pat. No. 2,772,721 jamming can occur between the scissor arms and also between seat plate and bottom frame.

Further disadvantages of the known art do exist with respect to a missing positive control of a complete draining of the lifting device and to the fact that no means are provided for holding the insert in a flat transportation position.

SUMMARY OF THE INVENTION

It is therefore one aim of the invention to improve a bathtub insert of the kind mentioned above having a seat plate instead of a much longer reclining platform in order to avoid any injuries of handicapped persons during lowering and raising of the seat plate.

One further object of the invention is to provide a novel bathtub insert having means for automatically bringing the insert into its flat transportation position after use and to secure the components thereof in this position.

One further object of the invention is to provide a bathtub insert having means to reduce the draining period of a water-filled lifting hose after use and to avoid any hand-operations for completely discharging water from the hose.

The novel bathtub insert according to the invention comprises a blind provided at a front end of the bathtub insert and consisting of a cover sheet, upper and lower ends of the cover sheet connected with the bottom frame and the seat plate respectively, the cover sheet having a width substantially equal with that of the bottom frame, one end of the cover sheet fastened at a winding tube rotatably mounted at one of the bottom frame and the seat plate respectively a spiral spring arranged within the winding tube and continuously exerting a rotatory force to the winding tube even in the lowermost position of the seat plate in order to hold the cover sheet tightly streched in all positions of the seat plate.

Thanks to this invention all moving components between the seat plate and the bottom frame remain completely covered by the blind so that handicapped persons cannot at all be injured. The pre-stressed blind provides means for automatically drawing the seat plate downwards against the bottom frame thus reducing the discharging period of the lifting hose and providing for a complete discharge without the need of hand-operations. The blind also provides means for holding the seat plate and bottom frame in contact with one another thus securing the insert in its transportation position. Therefore no additional mechanical locking means are necessary which would have to be unlocked before operation and otherwise would destroy the insert. The spring-stressed blind of this invention avoids this danger.

A further embodiment of the invention resides in that four ends of two pairs of two scissor arms have nonshiftable bearings and the other four ends thereof have bearings provided at sliding pieces displaceably guided in parallel rails respectively, said four nonshiftable bearings are arranged at the rearward end of the bathtub insert, wherein the two pairs of scissor arms have a common pivot axis in the central region of each one of the two pairs of scissor arms and wherein the lever length measured between said common pivot axis and the pivot axis of each one of the lower front end sliding pieces is larger than each one of the three remaining lever lengths measured between said common pivot axis and the bearings of the arms respectively. Thanks to this feature the seat plate moves in parallel relationship to the inclined head wall of the bathtub and no narrowing gap does exist therebetween, when the seat plate is lowered. Due to this concept the seat plate becomes rearwardly inclined during raising thereof so that the handicapped person cannot unintentionally slide forwards.

Additional characteristics and advantages of the invention appear from the sub claims and the following description of one embodiment of the invention in connection with the drawing.

DETAILED DESCRIPTION

Figure 3:
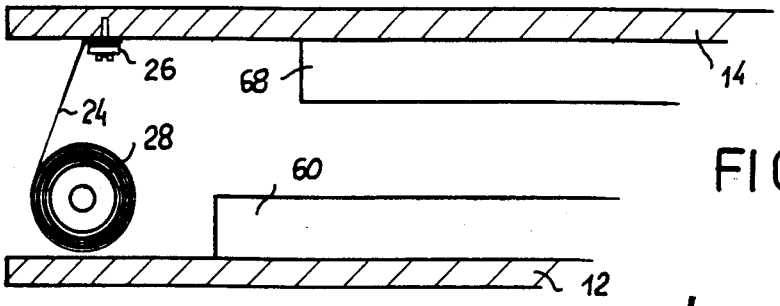
FIG. 3 shows a sectional side view of the front end of the bathtub insert in greater detail and with the seat plate near its lowermost position.
Figure 1:
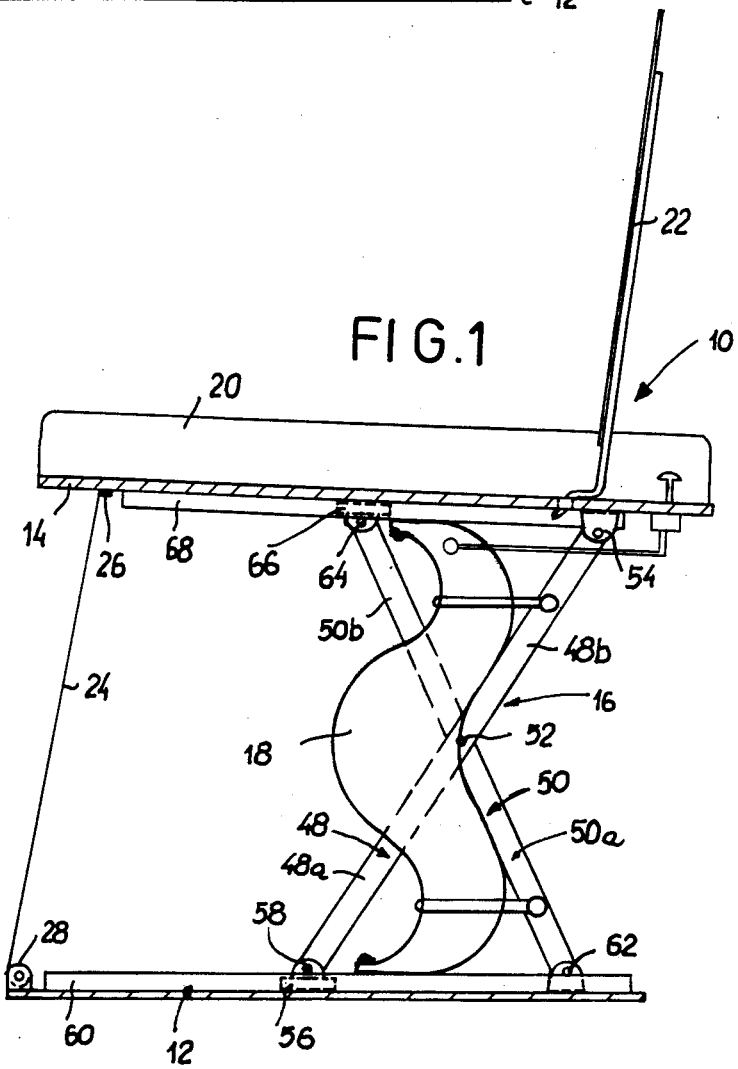
FIG. 1 shows a diagrammatic sectional side view of a bathtub insert.
Figure 2:
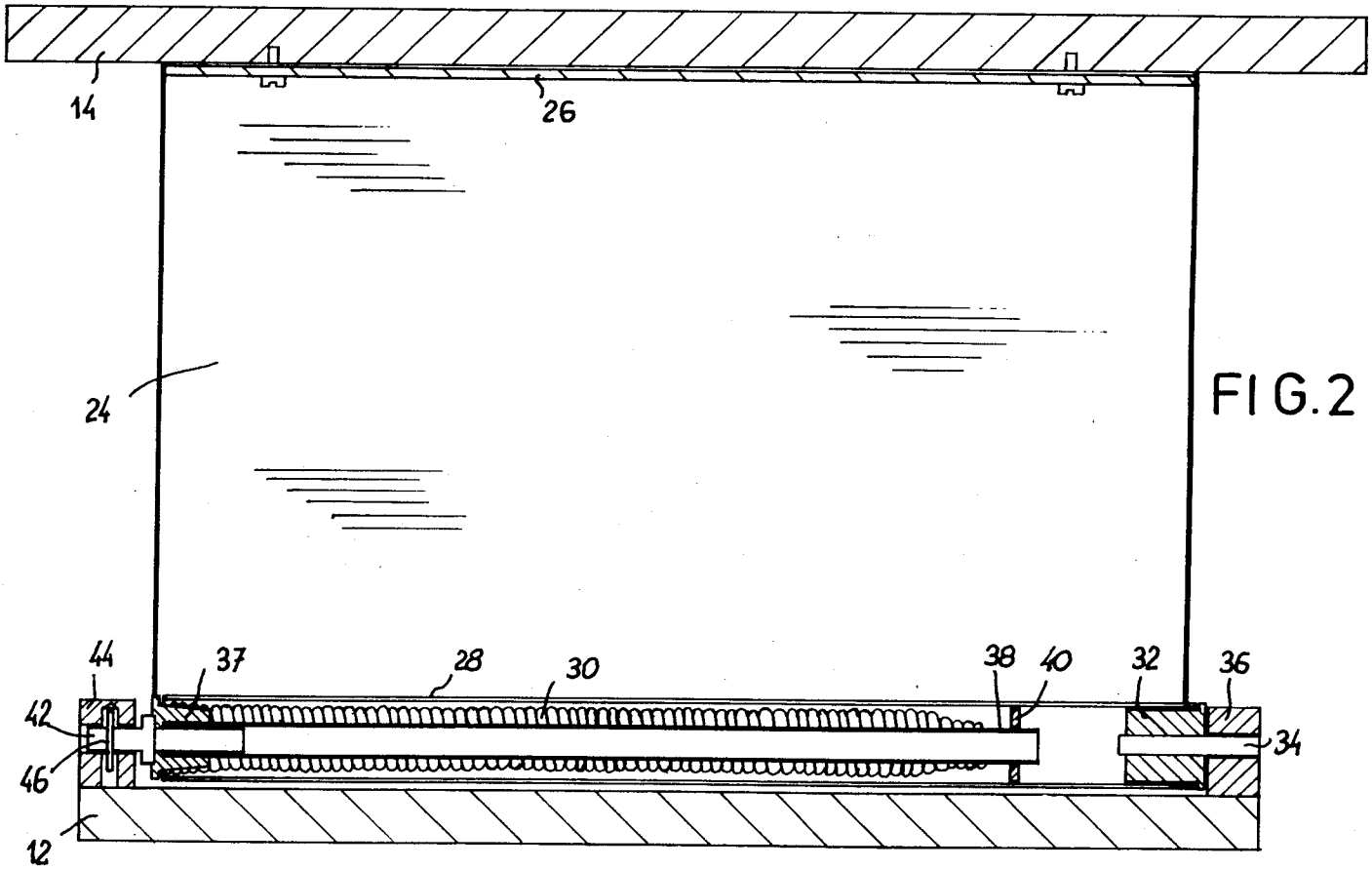
FIG. 2 shows a front end cross-section of the bathtub insert.

A bathtub insert 10 comprises a bottom frame 12, a seat plate 14, two pairs 16 of scissor arms and a lifting device in form of a foldable hose 18 the ends of which closed and fastened at the bottom frame 12 and the lower side of the seat plate 14. A pair of swinging plates 20 are pivotably connected along the longitudinal side edges of the seat plate 14 respectively and are springably pre-loaded into the plane of the seat plate 14. Spaced from the rearward edge of the seat plate 14 a back plate 22 is removably connected with the seat plate 14.

The front end of the bathtub insert 10 is closed between the bottom frame 12 and the seat plate 14 by means of a blind which consists of a flexible cover sheet 24 having substantially the same width as the bottom frame 12. The upper end of the cover sheet 24 is fastened at the lower side of the seat plate 14 by a ledge 26. The lower end of the cover sheet 24 is fastened at a winding tube 28 which is mounted for rotation in brackets 36, 44 fastened at the bottom frame 12. A long spiral torsional spring 30 is arranged within the winding tube 28. A plug 32 is inserted and fitted into one end of the winding tube 28 and has a coaxial shaft end 34 rotatably mounted in a bore of the bracket 36 which forms a bearing block. An end piece 37 is fastened in the opposite end of the winding tube 28, and a longitudinal hollow axle 38 is mounted for rotation in a bearing bore of the end piece 37. The hollow axle is surrounded by the spiral spring 30 and extends over the whole length thereof. The inner end of the spiral spring 30 is fastened at the hollow axle 38, at the end of which a guide ring 40 is fastened which is mounted for rotation in the winding tube 28. A coaxial projection 42 of the hollow axle 38 clamped therein projects through the end piece 37 and is fastened in the bracket 44 and held therein non-rotatably by means of a radial bolt 46. The spiral spring 30 is threaded on an outside thread of the end piece 37 and thereby fastened thereon. The diameter of the opposite end of the spiral spring 30 is reduced such, that it fits on the hollow axle 38.

Before mounting of the winding tube 28 the spiral spring must be tensioned. The hollow axle 38 is rotated by the bracket 44 fastened thereon and the winding tube 28 is held non-rotably. Thereby the tapered end of the spiral spring 30 clamps itself on the hollow axle 38 and then is tensioned to a great extend. In this condition the winding tube 28 is inserted with its shaft end 34 into the bracket 36 and while holding the winding tube 28 non-rotatably the opposite bracket 44 is fastened at the bottom frame 12 and the ledge 26 at the free edge of the cover sheet 24 is fastened at the bottom side of the seat plate 14. Thereby the seat plate 14 is drawn downwards to the bottom frame 12 and even in the lowermost position of the seat plate 14 when the latter contacts the bottom frame 12 the spiral spring 30 provides a sufficient tensioning effect for holding the seat plate 14 and the bottom frame in contacts.

Each pair 16 of scissor arms consists of arms 48, 50 of different lengths. The four arms 48,48, 50,50 are connected with one another by a common pivot axis 52. The arm 48 has a non-shiftable upper pivot bearing 54 near the rearward end of the seat plate 14 and a lower pivot bearing 58 provided at a sliding piece 56 which is guided for reciprocation in a rail 60. The longitudinal central axes of arms 48 and rail 60 are in the same vertical plane. Although the rail 60 needs only to extend from the front end to middle portion of the bottom frame 12, in this embodiment it extends almost over the whole length of the bottom frame 12. Thereby the bottom frame 12 is stiffened and itself can be a thin plate only.

In similar way both arms 50 mounted at rearward nonshiftable pivot bearings 62 of the bottom frame 12 near the insides of the rails 60. The opposite upper ends of the arms 50 are mounted in pivot bearings 64 of sliding pieces 66 reciprocably mounted in rails 68 fastened at the bottom face of the seat plate 14. Also here the rails 68 need only extend over the front half of the seat plate 14 but in the embodiment shown in fact do extend over nearly the whole length of the seat plate 14 to increase stability.

Both outside arms 48 are rigidly connected with one another by a hollow cross bar 70 close to the bottom-sided pivot bearings 56 thus forming a rigid U-shaped outer swinging frame 72. Both inner arms 50 are similarly connected with one another by a hollow cross bar 76 close to the upper side slide pieces 66. Additionally a second hollow cross bar 78 is inserted between the arms 50 near the non-shiftable bearings 62, thus forming a closed rigid inner swinging frame 80.

Assembling of the swinging frames 72,80 is accomplished by tension bolts 74 extending through the cross bars and adjacent walls of opposite arms 48,48 and 50,50 respectively. The ends of the cross bars are threaded and nuts 76 are fastened thereon.

Figure 4:
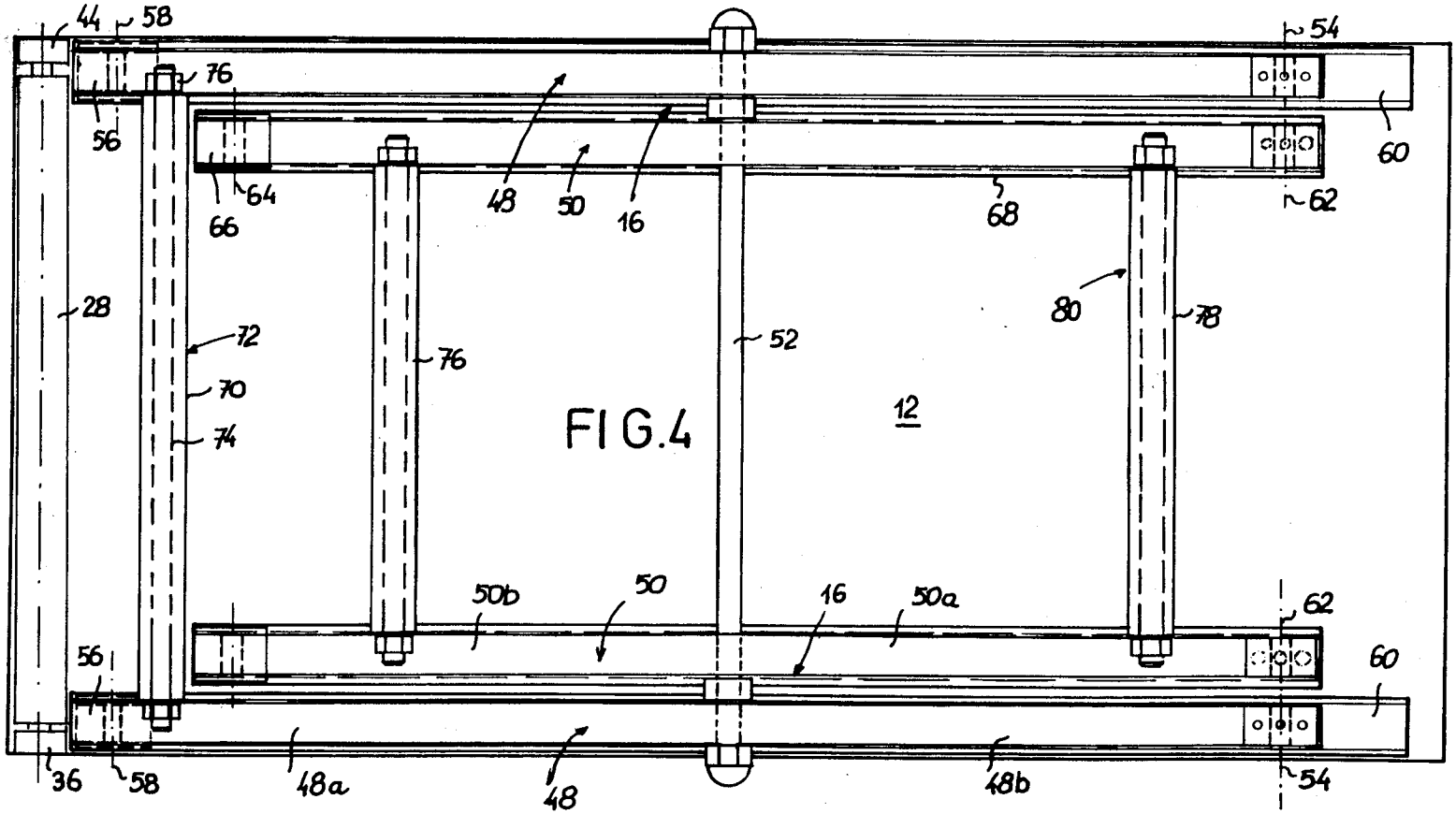
FIG. 4 shows a plan view of the bathtub insert after having removed the seat plate.

In the lowermost position of the bathtub insert 10 shown in FIG. 4, the outer swinging frame 72 rests on the rails 60 at the bottom frame 12 and is flush with the inner swinging frame 80 with the upper rails 68 contacting the arms 50 of the inner swinging frame 80.

With respect to the common pivot axis 52 each arm 48 constitutes a lower lever **48*a* and an upper lever 48*b* and each arm 50 has a lower lever 50*a* and an upper lever 50*b*. Both levers 50*a* and 48*b* are of equal length so that the axes of the bearings 54 and 62 of the four arms are transversely aligned when the bathtub insert 10 is in its lowermost position. The lower lever 48*a* is longer than the levers 48*b* and 50*a* of equal length by about 13 percent. Thereby the seat plate 14 when lifted at the same time is shifted rearwardly and also is brought into an inclined position with the front end on a higher level than the rearward end. The lever 50*b* of both arms 50 is about 9 percent shorter than the levers 50*a*, 48*b* of equal length. Thereby a too great inclination of the seat plate 14 is somewhat compensated to gain an appropriate resulting inclination which provides for a comfortable sitting and avoids that the handicapped person can unintentionally slide forward. The reduced length of the levers 50*b* with respect to the levers 48*a* allows the arrangement of the cross bar 70 and thereby construction of the outer rigid swinging frame 72 because the ends of these levers 50*b* lie close to the cross bar 70 substantially in the same plane when the seat plate 14** is in its lowermost position.

Some alternative embodiments within the scope of the invention consist in that the winding tube 28 is mounted at the bottom side of the seat plate 14 while the clamping ledge 26 is fastened at the bottom frame 12. Instead of a bottom plate as shown a rectangular frame consisting of a pair of bottom rails 60 and a pair of transverse struts or cross bars can be used. The bearings 62, brackets 36, 44 and the lower end of the hose 18 are fastened in this case at the rectangular bottom frame.

I claim:

1. A bathtub insert for handicapped persons comprising a bottom frame, a seat plate, a scissor-type quiding device arranged between said bottom frame and said seat plate and a lifting device consisting of a water-fillable hose closed at its ends, one end of the hose fastened at the bottom frame and the other end fastened at the seat plate, a pair of swinging plates pivotably connected at opposite side edges of the seat plate respectively and by spring means pre-stressed into the plane of the seat plate respectively, a blind provided at a front end of the bathtub insert and consisting of a cover sheet, upper and lower end of the cover sheet connected with the bottom frame and the seat plate respectively, the cover sheet having a width substantially equal with that of the bottom frame, one end of the cover sheet fastened at a winding tube rotatably mounted at one of the bottom frame and the seat plate respectively, a spiral spring arranged within the winding tube and continuously exerting a rotatory force to the winding tube even in the lowermost position of the seat plate in order to hold the cover sheet tightly stretched in all positions of the seat plate.

2. A bathtub insert as claimed in claim 1, wherein a plug is fitted into one end of the winding tube and is provided with a shaft end coaxially protruding outwards and mounted for rotation in a bearing block fastened at one of the bottom frame and the seat plate respectively and wherein an end piece is fastened at the opposite end of the winding tube, providing a bearing bore for an axle fastened outside of the winding tube in a holding block and extending through the bearing bore into the winding tube and ending in the opposite half thereof, and wherein the axle is surrounded by the spiral spring one end thereof fastened at the end piece and the other end fastened at the axle.

3. A bathtub insert as claimed in claim 1, wherein the cover sheet is inclined in rearward and upward direction and forms an angle in the range of 10° and 20° with a vertical plane.

4. A bathtub insert as claimed in claim 1, wherein four ends of two pairs of two scissor arms have non-shiftable bearings and the other four ends thereof have bearings provided at sliding pieces displaceably guided in parallel rails respectively, said four non-shiftable bearings are arranged at the rearward end of the bathtub insert, wherein the two pairs of scissor arms have a common pivot axis in the central region of each one of the two pairs of scissor arms and wherein the lever length measured between said common . pivot axis and the pivot axis of each one of the lower front end sliding pieces is larger than each one of the three remaining lever lengths measured between said common pivot axis and the bearings of the arms respectively.

5. A bathtub insert as claimed in claim 4, wherein the lever length measured between the common pivot axis and each one of the bearings of the upper front end sliding pieces is smaller than each one of the three remaining lever lengths measured between said common pivot axis and the bearings of the arms respectively.

6. A bathtub insert as claimed in claims 4 or 5, wherein all said non-shiftable bearings are at least substantially arranged in coaxial relationship with the seat plate in its lowermost position.

7. A bathtub insert as claimed in claim 1, wherein said scissor-type guiding device is composed of two pairs of two scissor arms respectively, one pair arranged at one side of the bathtub insert and the other pair at the opposite side thereof, each scissor arm at one end has a non-shiftable bearing at one of the bottom frame and the seat plate respectively and at the opposite end is journalled in a slide piece longitudinally displaceable in a rail fastened at the other one of the bottom frame and the seat plate respectively, wherein one scissor arm of one pair and one scissor arm of the other pair are transversely aligned and rigidly connected with one another, by a cross bar, whereby an inner rigid swinging frame and an outer rigid swinging frame are formed which are pivotably connected with one another and which are upside and downside flush with one another when the seat plate takes its lowermost position.

8. A bathtub insert as claimed in claim 7, wherein the ends of those scissor arms carrying the slide pieces and belonging to the inner swinging frame are positioned with only a small interspace behind the crossbar at the front end of the outer swinging frame when the seat plate takes its lowermost position.

9. A bathtub insert as claimed in claim 7, wherein the crossbars are threadedly connected endwise with the respective scissors arms.

10. A bathtub insert as claimed in claim 9, wherein the crossbars consist of hollow profile sections and a tension bolt extends longitudinally within the crossbar and the ends of the tension bolt lie within the scissor arms respectively.

* * * * *